US010174756B2

(12) United States Patent
Rodrigues et al.

(10) Patent No.: US 10,174,756 B2
(45) Date of Patent: Jan. 8, 2019

(54) RECIPROCATING COMPRESSOR VALVES ARRANGEMENT

(71) Applicant: Whirlpool S.A., Sao Paulo (BR)

(72) Inventors: Tadeu Tonheiro Rodrigues, Joinville (BR); Fabian Fagotti, Curitiba (BR); Dietmar Erich Bernhard Lilie, Joinville (BR)

(73) Assignee: Whirlpool S.A., Sao Paulo (BR)

( * ) Notice: Subject to any disclaimer, the term of this patent is extended or adjusted under 35 U.S.C. 154(b) by 0 days.

(21) Appl. No.: 15/529,156

(22) PCT Filed: Nov. 25, 2015

(86) PCT No.: PCT/BR2015/050226

§ 371 (c)(1),
(2) Date: May 24, 2017

(87) PCT Pub. No.: WO2016/082015

PCT Pub. Date: Jun. 2, 2016

(65) Prior Publication Data

US 2017/0356441 A1 Dec. 14, 2017

(30) Foreign Application Priority Data

Nov. 25, 2014 (BR) ..... 1020140294511

(51) Int. Cl.
*F04B 53/10* (2006.01)
*F04B 39/10* (2006.01)
*F04B 39/12* (2006.01)

(52) U.S. Cl.
CPC ..... *F04B 53/1047* (2013.01); *F04B 39/1073* (2013.01); *F04B 39/125* (2013.01);
(Continued)

(58) Field of Classification Search
CPC ..... Y10T 137/7892; Y10T 137/7893; Y10T 137/7891; F04B 53/1047; F04B 53/104;
(Continued)

(56) References Cited

U.S. PATENT DOCUMENTS 2,000,883 A * 5/1935 Cullen ..... F04B 39/0016 137/857
4,628,963 A * 12/1986 Ishijima ..... F04C 29/128 137/857

(Continued)

FOREIGN PATENT DOCUMENTS

EP 0 174 530 A2 3/1986
JP S55-24276 2/1980

(Continued)

*Primary Examiner* — Jessica Cahill
(74) *Attorney, Agent, or Firm* — Harrington & Smith

(57) ABSTRACT

The present relation relates to the technological field of compressors. Problem to be solved: The current reciprocating compressors valves arrangements includes valves whose flexion area suffer from direct interference of the body disposed immediately over said valve. Such feature, besides damaging de valve movement, further causes wear phenomena on the flexion areas of the valve, which can result in critical fault of the valve and consequently of the compressor. Resolution of the problem: It is revealed a valve arrange whose end valve capable of moving includes a flexion area previously defined and intentionally misaligned with any contact area of the body immediately disposed over the valve.

3 Claims, 3 Drawing Sheets

(52) U.S. Cl.
CPC ..... *F04B 53/104* (2013.01); *F04B 53/1037* (2013.01); *F04B 53/1085* (2013.01); *Y10T 137/7891* (2015.04)

(58) Field of Classification Search
CPC . F04B 53/1085; F04B 39/1073; F04B 39/125
See application file for complete search history.

(56) References Cited

U.S. PATENT DOCUMENTS

| | | | | |
|---|---|---|---|---|
| 4,911,614 | A * | 3/1990 | Kawai | F04B 39/1073 137/514 |
| 5,601,118 | A * | 2/1997 | Jang | F04C 29/128 137/856 |
| 7,493,915 | B2 * | 2/2009 | Lee | F01L 3/205 137/856 |
| 2002/0085931 | A1 | 7/2002 | Lee et al. | 417/312 |
| 2008/0202613 | A1 * | 8/2008 | Yamaoka | F04B 39/1073 137/855 |

FOREIGN PATENT DOCUMENTS

| | | |
|---|---|---|
| JP | S60-8577 | 1/1985 |
| JP | 2002-235660 | 8/2002 |
| JP | 2013-177820 | 9/2013 |
| WO | WO 2006/027864 A1 | 3/2006 |
| WO | WO 2007/116989 A1 | 10/2007 |

* cited by examiner

RECIPROCATING COMPRESSOR VALVES ARRANGEMENT

FIELD OF THE INVENTION

The invention in question refers to a reciprocating compressor valves arrangement and, more particularly, a valves arrangement integrated by at least one main valve, at least one support and/or fixing means and, optionally, at least one auxiliary valve. According to the invention, such valves arrangement is capable of avoid mechanical interferences and wear between the functional regions of the valves, during operation of the same, without the need to use separator elements and/or bearers, as occurs in valves arrangements counterparts pertaining to the current state of the art.

The invention in question is specially intended to valves arrangement where the main valve and the auxiliary valve comprises, both, reed valves, which are traditionally used in hermetic reciprocating compressors applied in cooling systems.

BACKGROUND OF THE INVENTION

As it is known by technicians on the art, reciprocating compressors comprises electromechanical equipment capable of compress certain gases as work fluids. The reciprocating compressors used in cooling systems are specially capable of compressing coolants.

Among a plurality of subsystems and components that integrate a reciprocating compressor, it is highlighted—according to the invention in question—the valves system, which is composed by valves capable of control the fluid flows that are sucked and discharged by the compression mechanism of the compressor.

Generally, valves arrangement of reciprocating compressor is composed by at least one suction valve (disposed beneath plate-valve, inside the compression cylinder of the compression mechanism) and at least one exhaust valve (disposed over the plate-valve, inside the exhaust chamber of the head of the compression mechanism of the compressor). Valve arrangements of this kind of compressor are broadly known by technicians on the art.

Specially, and in view of the small size hermetic reciprocating compressors, normally applied in cooling systems, it is common that the valves which integrated the valves arrangement comprises reed valves, that is, valves defined by a flexible metallic foil, which have one of it ends fixed (in a fixed element, by a support and/or fixing means) and another moving end, this being generally aligned with the suction or exhaust port by which exists flow of the work fluid. Reed valves also are extremely known by technicians on the art.

Furthermore, it is still known that some valve arrangements belonging to the current state of the art comprises, beyond the "main" valve (which can be a suction valve or an exhaust valve, or both) at least one auxiliary valve. The use of the auxiliary valve is more common in set with exhaust valves, but not limited to this. The auxiliary valve is assembled between the main valve and the exhaust stop, which is a rigid limiter of the valve movement path. An auxiliary valve infers a spring effect on the main valve, from specific openings of the main valve. For the opening process, by reaching the contact height with the auxiliary valve, the set slows, due to higher rigidity of auxiliary valve, before the contact with the stop, avoiding high impact speeds that can fracture the valve. The quantity of movement of the main valve is stored on the auxiliary valve, with spring force, which is returned accelerating the main valve for the closing process avoiding gas reflux of the exhaust chamber for the compression chamber, which degrades the compressor efficiency. In a general way, either for suction valves or exhaust valves, since they are reed valves, is common the use of auxiliary valves, this also comprises reed valves.

However, and considering that the main valve and the auxiliary valve have at least one end capable of moving, being this end free or supported, can be observed some problems related to moving dynamic between such valves.

In general lines, such problems refer to basically the occurrence of wear on the fixing region of main and auxiliary valve. On the limit of the functional and fixing regions, here called crimping lines where the valve flexion occurs, there is an intense and frequent micro-displacement related and tangential between the main and auxiliary valve, which is a common wear mechanism. This process is aggravated if the fixing means exerts compressive tension concentrated on this limit region. This configuration is usually found in reciprocating hermetic compressors, which eventually may fail depending on the biasing applied to the valve system, being this the intense relative movement and normal strength of fixing near the valve flexion region.

The current state of the art comprises some constructive solutions intended to mitigate this problems, among them highlights the solutions described on patent documents JP2013177820 and WO2007116989.

Patent document JP2013177820 describes an arrangement of valves fundamentally integrated by a main valve, an auxiliary valve, a valve stop and a fixing means. On this arrangement the main valve is spaced from the auxiliary valve by means of a spacer element, which is also fixed by fixing means. Said spacer element prevents the valves to have physical contact between them on the region that they are fixed (fixing means region), reducing, consequently, the occurrence of wear on the valves flexion region. However, introducing an additional body—the spacer element—does not eliminate all negative aspects, which also keeps the fixing strength over the flexion areas. From a constructive point of view increases the complexity and cost by the addition of a component of the valves system.

Patent Document WO2007116989 describes a valve arrangement fundamentally integrated by a main valve, an auxiliary valve, a valve stop and a fixing means. On this arrangement the auxiliary valve is particular in view that shows on the fixing region appendix stamped which works as elastic spacers of spring effect. The valve stop has a protruding portion that on being pressed by the cylinder lid presses the auxiliary valve on the spacers region which transmits part of the fixing strength, but keeping certain spacing. This spacing prevent that the valves have physical contact between them on the region that they are fixed (fixing means region), reducing, consequently, the occurrence of wear on the valves flexion region. However, using an auxiliary valve and stop as described on document WO2007116989, because involves a more complex construction, requests production processes more complexes and costly.

This way, and having in mind that the current state of the art lacks of simple solutions capable of reducing reliability problems related to wear on valves arrangements provided by at least one main valve and at least one auxiliary valve, emerges the invention in question.

OBJECTIVES OF THE INVENTION

Therefore, it is a main objective of the invention in question reveals valves arrangement of reciprocating compressor that, composed by at least one main valve and at least one auxiliary valve, is free of said reliability problems and is effective for controlling gas flow, fundamental to the compressor efficiency. In this sense, it is also a main objective of the invention in question that such problems be solved without using complex components (as the valve stop described on patent document WO2007116989) and without the addition of additionally components (as the spacer element described on patent document JP2013177820).

In this sense, it is one of the objectives of the invention in question that the valves are mounted juxtaposed, without having spacing between both on the fixing region.

It is still one of the objectives of the invention in question that all the valves moving dynamic, related to the fixing elements of the valves arrangement of the reciprocating compressor, also develops without the occurrence of wear on the flexion regions of the main and auxiliary valves and keeps the effective functionality on the flux control of the cooling fluid.

It is also an objective of the invention in question reveal an optional embodiment whose valves arrangement of reciprocating compressor is integrated just by a main valve and the stop, being still observed all advantages and benefits of the preferential embodiment.

SUMMARY OF THE INVENTION

The above mentioned objectives are, totally, reached in function of the valves arrangement of reciprocating compressor revealed here, which comprises at least one main valve and at least one valve stop, where the main valve comprises at least one fixing end, at least one moving end and at least one flexion area, and where the valve stop comprises at least one support area outlined by at least one end.

According with the invention in question, the flexion area of main valve and the end of the support valve of the valve stop are longitudinally misaligned to each other.

More particularly, it is predicted a related dimension to the defined extension between the beginning of the fixing base and the beginning of the flexion area of the main valve and a dimension related to a defined extension between the beginning of the support area and the end of the valve stop, being the first relational dimension larger than the second relational dimension. Preferably, the first relational dimension is from 1.2 to 2.5 times larger than the second relational dimension.

According to one alternate embodiment of the invention in question, it is further predicted the existence of at least one auxiliary valve comprising at least one fixing end and at least one flexion area, being said valve an auxiliary valve disposed between the main valve and the valve stop. In this embodiment, the fixing end of the main valve, the fixing end of the auxiliary valve and the support area of the valve stop are juxtaposed to each other. Furthermore, the flexion area of the main valve, the flexion area of the auxiliary valve and the support area end of the valve stop are longitudinally misaligned to each other.

In this alternative embodiment there are foreseen three relational dimensions: the first related to the extent defined between the beginning of the support area and the end of the valve stop, the second related to the extension defined between the beginning of the fixing base and the beginning of the flexion area of the auxiliary valve, and the third related to the extension defined between the beginning of the fixing base and the beginning of the flexion area of the main valve. Thus, the third relational dimension is more than the first relational dimension, being the second relational dimension more than the first relational dimension and less than the third relational dimension.

More particularly, the third relational dimension is from 1.2 to 2.5 times more than the first relational dimension, and the second relational dimension is 1.1 to 2.4 times more than the first relational dimension, respecting that the second relational dimension is always less than the third relational dimension.

BRIEF DESCRIPTION OF THE DRAWINGS

The invention in question is detailed based on the figures above listed, in which.

DETAILED DESCRIPTION OF THE INVENTION

Considering the objectives of the invention in question, it is revealed a valves arrangement of reciprocating compressor where the flexion point of the valve (reed, suction or exhaust valve) is intentionally misaligned, being preferably extended, related to the valve stop and/or related to the element immediately disposed on the valve, as for example, an auxiliary valve.

In the preferred embodiment in question, the element immediately disposed on the valve is an auxiliary valve (known by technicians on the art), being so the major flexion point of the main valve intentionally misaligned related to the flexion point of the auxiliary valve.

In the preferred embodiment in question, the element immediately disposed on the valve is an auxiliary valve (known by technicians on the art), being so the flexion point of the main valve intentionally misaligned related to the support area of the valve stop.

Figure 1:
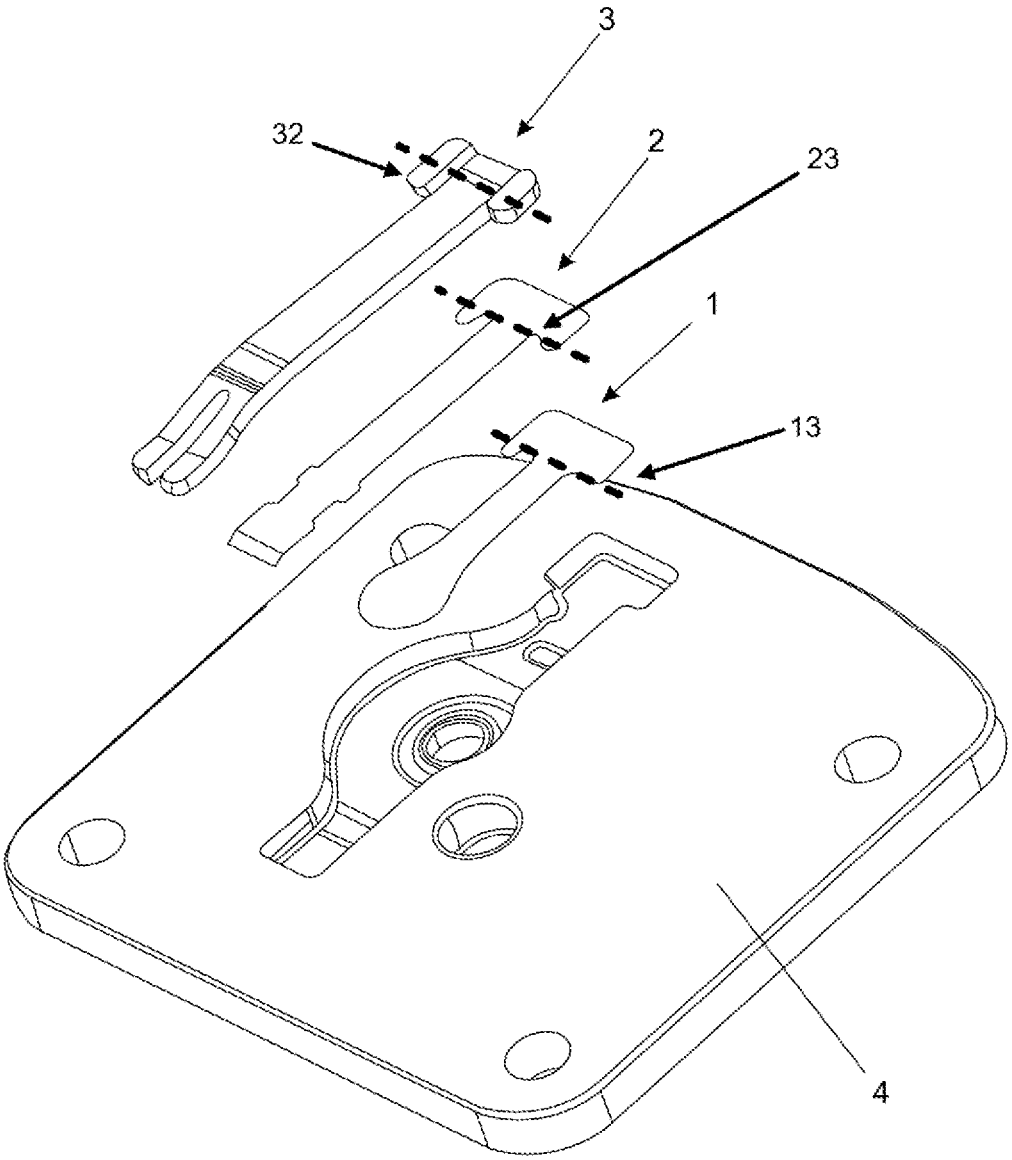
FIG. 1 shows, in exploded perspective, the preferential embodiment of the invention in question.
Figure 2:
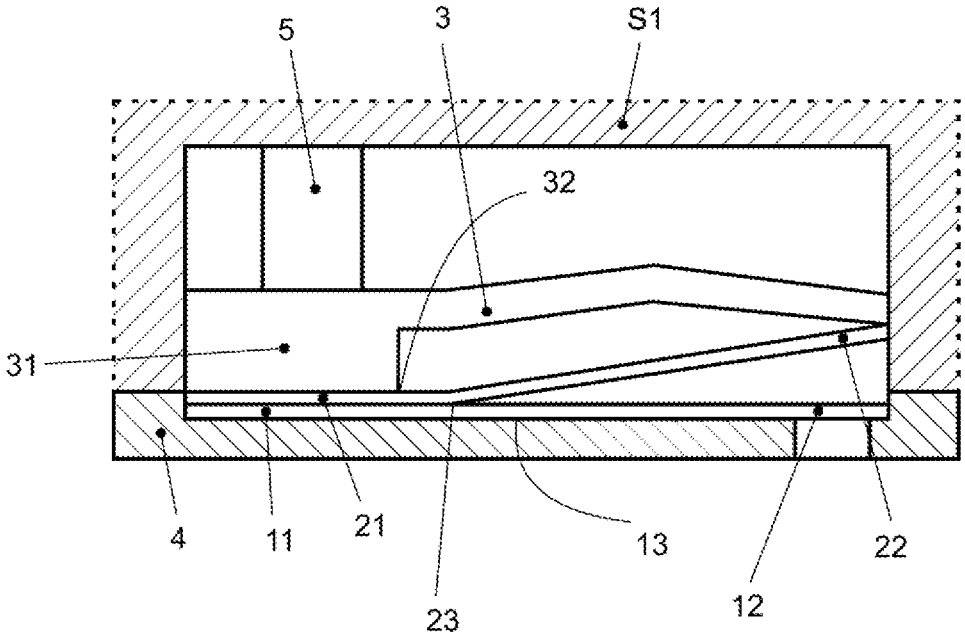
FIGS. 2 and 3 shows, schematically, the inventive core of the preferential embodiment of the invention in question.
Figure 3:
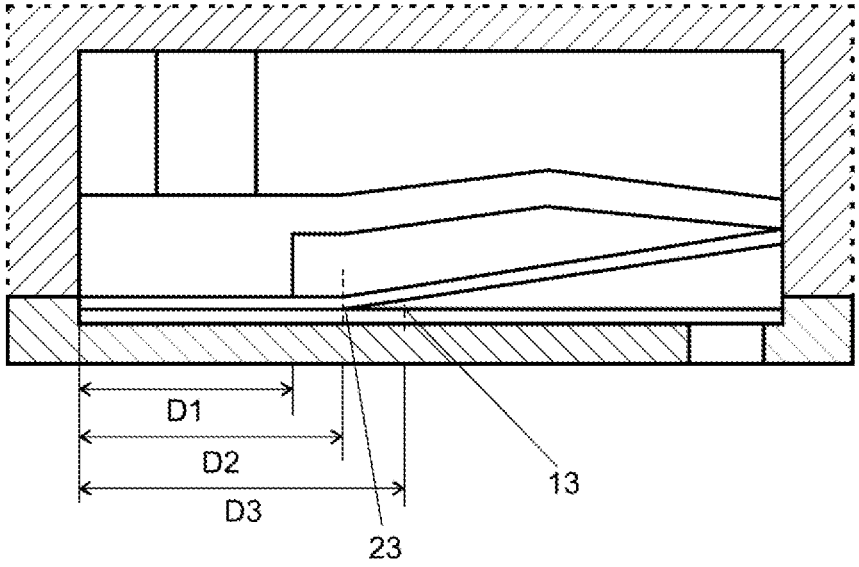

As shown on FIGS. 1, 2 and 3, the preferential embodiment of the invention in question comprises a valve arrangement of reciprocating compressor, preferentially hermetic and applied in cooling systems, integrated by a main valve 1 (that can comprises a suction valve or an exhaust valve), an auxiliary valve 2, a vale stop 3 and a support body 5.

The main valve 1 comprises a reed valve, is preferentially made by metallic alloy, and is integrated by a fixing end 11, a moving end 12 and a flexion end (or point) 13.

The auxiliary valve 2 is conceptually analogue to the main valve 1, comprising a reed valve, is preferentially made by metallic alloy, and is integrated by a fixing end 21, a moving end 22 and a flexion area (or point) 23.

It is common that the main 1 and auxiliary 2 valves are geometrically similar and flat (having its ends 11 and 12 longitudinally aligned, and the ends 21 and 22). However, an alternate configuration for the auxiliary valve 2 is found, being this pre-tensioned (having its ends 21 and 22 longitudinally misaligned from its flexion point 23).

This occurs because, as it is known by technicians of the art, the main valve 1 is projected so that its moving end 12 presents resilient movement during all the operation of the compressor, while the auxiliary valve 2 is projected to damp the moving of said main valve 1.

However, the preferential embodiment of the invention in question further comprises a valve stop 3.

The valve stop, as it is known by technicians on the art, is about a component that limits the opening stroke of the main 1 and auxiliary 2 valves. In this case helps also the assembling and maintenance of valves positioning 1 and 2 related to the plate valve 4, and comprising at least one support area 31.

The assembling of the preferential embodiment of the valves arrangement of the reciprocating compressor is simple: the main valve 1 is disposed on an specific housing of the plate-valve 4; the auxiliary valve 2 is directly disposed over the auxiliary valve 2, the valve stop 3 is directly disposed on the auxiliary valve 2 and a support body 5 (normally belonging to lid 51 from compressor head) is disposed over the valve stop 3.

The great merit of the invention in question consists on the fact that, different from what occurs on documents JP2013177820 and WO2007116989, the fixing ends 11 and 21 of valves 1 and 2 are juxtaposed to each other, being both indirectly supported on the same support body 5 though a same valve stop 3.

Therefore, and still referring to the great merit of the invention, the flexion areas 13 and 23 of valves 1 and 2 and end 32 of support area 31 of stop 3 are longitudinally misaligned to each other, being the flexion region 13 downwardly the end 32 and the flexion region 23 is between the flexion region 13 and the end 32.

For such feature to be reached, it is necessary that both the flexion area 13 of main valve 1 and the flexion area 23 of auxiliary valve 2 and the end 32 of support area 31 from stop 3 are previously established, what is not necessarily common in reed valves belonging to the current state of the art. However, this need is easily reached, simply, in example, defining intentionally the extent of the fixing bases 11 and 21, which are more rigid, during the own process of production (metallic foil stamping) of the valves.

Thus, it is possible "spacing" the flexion region 13 of the main valve 1 related to the end 32 of the support area 31 from the stop 3, and related to the flexion region 23 of the auxiliary valve 2.

This "spacing" or longitudinally misalignment between the flexion areas 13 and 23 of valves 1 and 2 and the end 32 of the support area 31 from the stop 3 eliminates the contact between the flexion and the fixing area and also allows that the moving end 12 of the main valve 1 is freely moved (through "automatic" actuation or "command" actuation), which turns to eliminate wear phenomena of valves and also allows the functioning.

The "spacing" or longitudinally misalignment between the flexion areas 13 and 23 of valves 1 and 2 and the end 32 of the support area 31 of the stop 3 is better observed on FIG. 3, through the dimensional referential D1, D2 and D2.

Dimension D3, related to main valve 1, comprises the length or extension of the fixing base 11 of the main valve 1, this is, comprises all the valve part 1 defined between the beginning of the fixing base 11 until the beginning of the flexion area 13.

The dimension D2, related to the auxiliary valve 2, comprises the length or extension of the fixing base 21 of the auxiliary valve 2, this is, comprises all the valve part 2 defined between the beginning of the fixing base 21 until the beginning of the flexion area 23.

The dimension D1, related to the valve stop 3, comprises the length or extension of the support area 31 of stop 3, this is, all the part defined between the beginning of the support area 31 until said end 32 of the support area 31.

Thus, according to the invention in question, the dimension D3 is more than the dimension D1, being the dimension D2 more than the dimension D1, but less than the dimension D3.

More particularly, and preferentially, the distance D3 is from 1.1 to 2.5 times more than the distance D1 and the distance D2 is 1.2 to 1.4 times more than the distance D1.

Figure 4:
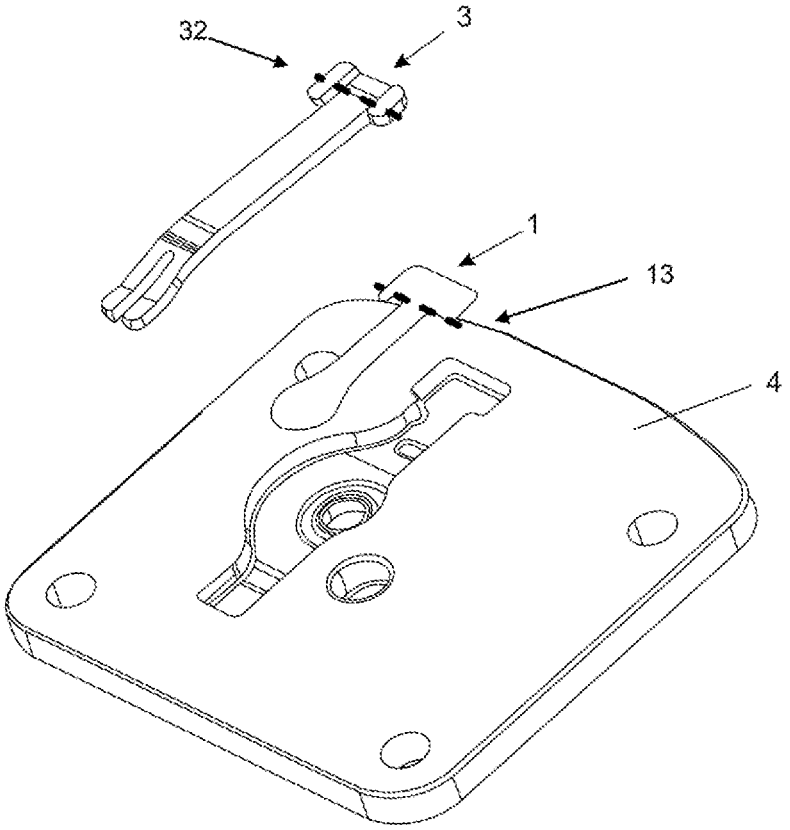
FIG. 4 shows, in exploded perspective, the alternate embodiment of the invention in question.
Figure 5:
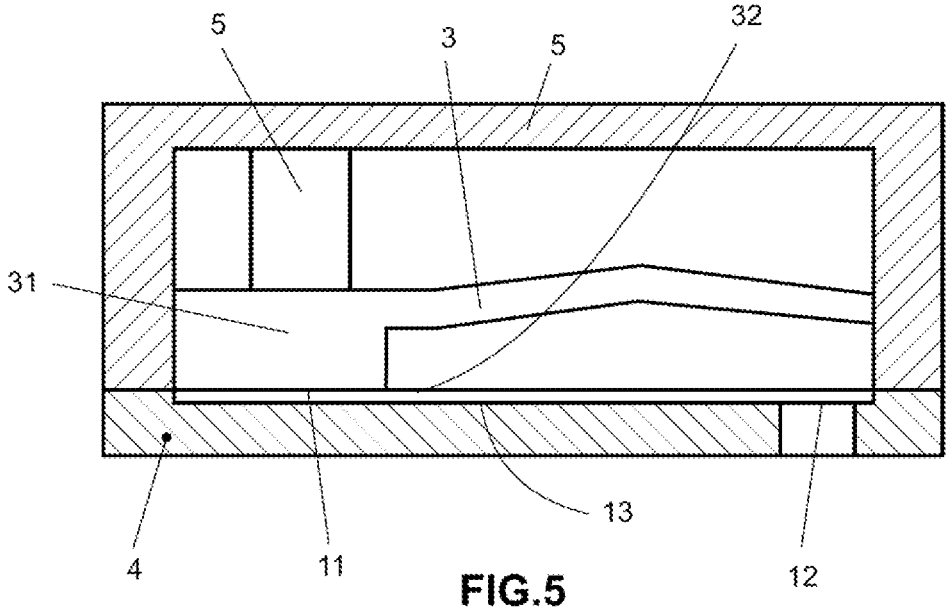
FIG. 5 shows, schematically, the inventive core of the preferential embodiment of the invention in question.

As shown on FIGS. 4 and 5, the alternative embodiment of invention in question comprises an arrangement of reciprocating compressor valves, preferably hermetic and applied in cooling systems, integrated by a main valve 1 (that can comprises a suction valve or an exhaust valve), a valve stop 3 and a support body 5, this is, a valves arrangement free of auxiliary valves.

Generally, the preponderant features of preferential embodiment of the invention in question are present on the alternative embodiment.

Thus, and as shown on FIG. 5, the flexion area 13 of main valve 1 and the end 32 of support area 31 from stop 3 are longitudinally misaligned to each other, being the flexion region 13 downwardly the end 32.

Although not shown, alternative embodiment also respects the premise that the dimension D3 is more than the dimension D1.

Having being described and shown two embodiments of the invention in question, it should be understood that the protection scope in question can include other possible variations, which are limited just by the content of the claims, here included the possible equivalent means.

The invention claimed is:

1. Reciprocating compressor valves arrangement, comprising a main valve and a valve stop;

the main valve comprising a fixing end, a moving end, and a flexion area;

the valve stop comprising a fixing support area outlined by a crimping line end;

the beginning of the flexion area of the main valve being a transverse flexion line, and the transverse flexion line of the flexion area of the main valve and the crimping line end of the fixing support area of the valve stop are longitudinally misaligned among them;

further comprising an auxiliary valve comprising a fixing end and a transverse flexion line, said auxiliary valve being disposed between the main valve and the valve stop, the fixing end of the main valve, and the fixing end of the auxiliary valve and the fixing support area of the valve stop are fixed one above each other;

characterized by the transverse flexion line of the main valve, the transverse flexion line of the auxiliary valve, and the crimping line end of the fixing support area of the valve stop are longitudinally misaligned to each other.

2. Reciprocating compressor valves arrangement, according to claim 1, foreseen:

a third dimension related to a third extension between the beginning of the fixing end and the beginning of the flexion area of the main valve;

a second dimension related to a second extension between the beginning of the fixing end and the beginning of the flexion area of the auxiliary valve; and a first dimension related to a first extension between the beginning of the fixing support area and the crimping line end of the valve stop, the reciprocating compressor valves arrangement being characterized by the third dimension being larger than the first dimension, and the second dimension being larger than the first dimension and less than the third dimension.

3. Reciprocating compressor valves arrangement, according to claim 2, characterized by:

the third dimension being from 1.2 to 2.5 times larger than the first dimension; and the second dimension being 1.1 to 2.4 times larger than the first dimension, respecting that the second dimension should always be less than the third dimension.

* * * * *